US005168697A

United States Patent [19]

Brockmanns et al.

[11] Patent Number: 5,168,697

[45] Date of Patent: Dec. 8, 1992

[54] APPARATUS FOR CHANGING YARN CARRIERS IN A SPINNING OR TWISTING MACHINE

[75] Inventors: Karl-Josef Brockmanns, Willich; Heinz Kamp, Wegberg; Robert Hartel, Aachen, all of Fed. Rep. of Germany

[73] Assignee: W. Schlafhorst AG & Co., Mönchengladbach, Fed. Rep. of Germany

[21] Appl. No.: 793,273

[22] Filed: Nov. 7, 1991

Related U.S. Application Data

[63] Continuation of Ser. No. 572,053, Aug. 23, 1990, abandoned.

[30] Foreign Application Priority Data

Aug. 23, 1989 [DE] Fed. Rep. of Germany ..... 3927829

[51] Int. Cl.[5] ..... D01H 9/02; D01H 1/00; B65H 67/04

[52] U.S. Cl. ..... 57/313; 57/75; 57/276; 57/281; 57/354

[58] Field of Search ..... 57/67, 75, 273, 276, 57/313, 354

[56] References Cited

U.S. PATENT DOCUMENTS

| | | | |
|---|---|---|---|
| 3,391,527 | 7/1968 | Kato | 57/34 |
| 3,903,681 | 9/1975 | Bonus | 57/90 |
| 4,342,188 | 8/1982 | Okamoto | 57/89 |
| 4,473,997 | 10/1984 | Kawasaki et al. | 57/266 X |
| 4,697,692 | 10/1987 | Kupper et al. | 57/281 X |
| 4,938,017 | 7/1990 | Stadele | 57/270 X |
| 4,953,350 | 8/1990 | Schulz et al. | 57/354 |
| 4,959,953 | 10/1990 | Kranietz | 57/354 |
| 4,978,081 | 12/1990 | Kopper | 57/281 X |
| 5,016,434 | 5/1991 | Kamp | 57/266 X |
| 5,022,223 | 6/1991 | Mena | 57/276 X |

FOREIGN PATENT DOCUMENTS

| | | |
|---|---|---|
| 390172 | 2/1924 | Fed. Rep. of Germany . |
| 628987 | 4/1936 | Fed. Rep. of Germany . |

*Primary Examiner*—Daniel P. Stodola
*Assistant Examiner*—William Stryjewski
*Attorney, Agent, or Firm*—Herbert L. Lerner; Laurence A. Greenberg

[57] ABSTRACT

An apparatus for changing yarn carriers in a textile machine, particularly a ring spinning machine, funnel spinning machine or ring twisting machine, includes a revolver having an axis, a pair of spindles being disposed on the revolver symmetrically to the revolver axis and having axes, and the spindles of the pair being rotatable in mutual alternation between a spinning position and an unwinding or disposal position. According to one embodiment, the axes of the spindles of the pair are inclined relative to the revolver axis by an acute angle and diverge in a direction toward the free ends of the spindles. According to another embodiment, at least two pairs of spindles are disposed on the revolver for serving at least two adjacent spinning or twisting stations of the textile machine, and each two adjacent spindle axes are mutually parallel at a given spacing.

16 Claims, 3 Drawing Sheets

APPARATUS FOR CHANGING YARN CARRIERS IN A SPINNING OR TWISTING MACHINE

This application is a continuation of application Ser. No. 572,053, filed Aug. 23, 1990, now abandoned.

The invention relates to an apparatus for changing yarn carriers in a textile machine, in particular a ring spinning machine, funnel spinning machine or ring twisting machine, in which a pair of spindles is disposed on a revolver symmetrically to the revolver axis, in such a way that one spindle is rotatable in alternation with the other spindle of the pair from a spinning position into an unwinding or disposal position, and vice versa.

The spinning cops produced on ring spinning machines contain a quantity of yarn that is too small for most applications and must be rewound onto substantially larger cross-wound bobbins or cheeses. In the past, the transfer of the finished spinning cops from the spinning stations to the unreeling or unwinding stations was as a rule associated with labor-intensive manipulation of the spinning cops, from the doffing process at the spinning machine through transportation to the winding unit, alignment of the finished spinning cops and preparing them at special preparation stations, mounting them on the unreeling or unwinding spindles, and finally transporting the empty tubes back to the spinning machine and remounting them on the spindles. U.S. Pat. No. 3,391,527 discloses an apparatus of such a type, in which both the changing of yarn carriers constructed as bobbin tubes and the complicated transportation of the tubes to and from the spinning systems, are dispensed with. The two spindles disposed on the revolver parallel to the revolver axis must be spaced apart sufficiently, so that the spinning process on one hand and the unreeling or unwinding process on the other hand, can be performed simultaneously, unhindered by one another. The diameter of the revolvers carrying the parallel spindles must be correspondingly large. As a result, when conventional changing spindles are used, the distance between adjacent spinning stations, i.e., the spindle spacing, must be increased, thus necessitating extensive modification of the ring spinning machines.

The invention will be described below in conjunction with a ring spinning machine, in particular a ring spinning and winding machine, in which bobbin tubes are used as the yarn carriers. The invention is equally applicable, with the same advantages, to ring twisting machines, funnel spinning machines, and the like. The invention is also unlimited in terms of the way in which the yarn carrier is constructed. Cylindrical or conical tubes, or the mandrels themselves, may be used as yarn carriers It is accordingly an object of the invention to provide an apparatus for changing yarn carriers in a spinning or twisting machine, which overcomes the hereinaforementioned disadvantages of the heretofore-known devices of this general type and which does so in such a way that previously contradictory requirements for small revolver diameters and winding station spacings on one hand and relatively large open spaces for unhindered simultaneous performance of the spinning and unwinding or unreeling operations on the other hand, can all be met.

With the foregoing and other objects in view there is provided, in accordance with the invention, an apparatus for changing yarn carriers in a textile machine, comprising a revolver having an axis, a pair of spindles being disposed on the revolver symmetrically to the revolver axis, the spindles having axes, ends disposed on the revolver and free ends, the spindles of the pair being rotatable in mutual alternation between a spinning position and an unwinding or disposal position, the axes of the spindles of the pair being inclined relative to the revolver axis by an acute angle and diverging in a direction toward the free ends of the spindles.

In this version, the invention exploits the recognition that the space required for a spinning and winding station in the generic apparatus is dependent practically solely on the maximum diameter of the revolver, while the span width of the spindles and the tubes carried by them is relatively uncritical. In fact, the spindles of one revolver which diverge upward from one another according to the invention, follow a frustoconical path upon a change of spindles. This path can overlap the adjacent revolver without hindrance, and can even plunge in between its correspondingly diverging spindles. It is merely important for the adjacent revolvers to be rotated with a phase offset, so that upon rotation the spindles can engage the gap existing between the stationary spindles of the adjacent revolvers in toothlike fashion. If the spindles are suitably inclined on the revolvers, considerable free room is created in the spindle top region, precisely at the points where large free spaces are needed for a hindrance-free spinning and unreeling or unwinding operation.

With the objects of the invention in view there is also provided an apparatus for changing yarn carriers in a textile machine having spinning or twisting stations, comprising a revolver having an axis, at least two pairs of spindles disposed on the revolver symmetrically to the revolver axis for serving at least two adjacent spinning or twisting stations, the spindles of each respective pair pair being rotatable in alternation with each other between a spinning position and an unwinding or disposal position, the spindles having axes, and each two adjacent spindle axes being mutually parallel at a given spacing.

A compact structure and a simplified ability to serve adjacent spinning or twisting stations can be attained with such an embodiment of the invention. In this embodiment, the exchange of spindles of two or more spinning or winding stations can be achieved by rotating a single revolver.

In accordance with another feature of the invention, the revolver has two spindles, the spindle axes are angularly offset by 180° and form the generatrix of a cone being open toward the free spindle ends, and the cone having a center axis being the revolver axis.

In accordance with a further feature of the invention, the spindle axes extend vertically in the spinning position, and the revolver axis is inclined by an acute angle relative to a vertical plane. In this way, the conventional embodiment of the ring spinning machine can be retained with the exception of the spinning spindle retainer itself.

The axis of the spindle in the unreeling or unwinding position is inclined from the horizontal plane by between 0° and 50°, and preferably between 30° and 50°, depending on the angle of inclination between the two spindle axes.

The distance between two adjacent rotary axes of revolvers and thus the spinning station spacing can be reduced even further if, in accordance with an added feature of the invention, each revolver has recesses being curved in the form of arcs in the region of circumferential segments located between the spindle outlets, the radius of curvature of which is adapted to the distance from the adjacent revolver axis. The result is a revolver having a maximum diameter in the plane of the two spindle axes and a minimum diameter at right angles to the connecting plane. When rotating during the exchange of bobbin tubes, the maximum diameter of the revolver engages the recesses in the adjacent revolvers.

In accordance with an additional feature of the invention, the revolvers have circumferential regions remote from the axes thereof, and adjacent revolvers have circumferential dimensions and distances between each other causing the circumferential regions to plunge into a recess of an adjacent revolver held stationary in a spinning station upon rotation about its own revolver axis.

In order to avoid the formation of double yarns or flats, after a change of bobbin tubes, the yarn of the spinning station should be severed from the top winding of the finished wound cop. To this end, in accordance with a concomitant feature of the invention, there are provided yarn cutters associated with each spindle pair, operating in the region between the spindles located in the spinning position and in the winding position.

Other features which are considered as characteristic for the invention are set forth in the appended claims.

Although the invention is illustrated and described herein as embodied in an apparatus for changing yarn carriers in a spinning or twisting machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
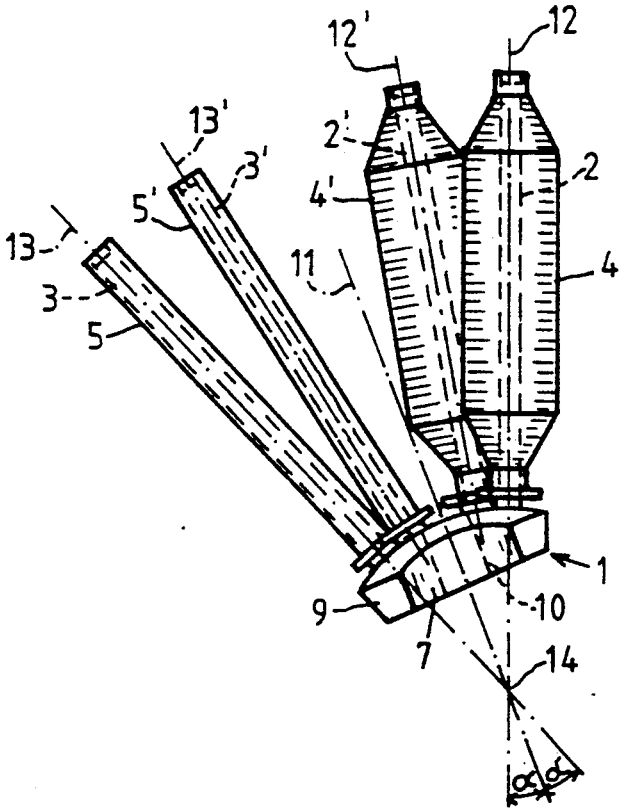
FIG. 1 is a diagrammatic, elevational view of a configuration of two adjacent revolvers, which are disposed in different positions and are each equipped with two spindles, as seen in the longitudinal direction of the machine.
Figure 2:
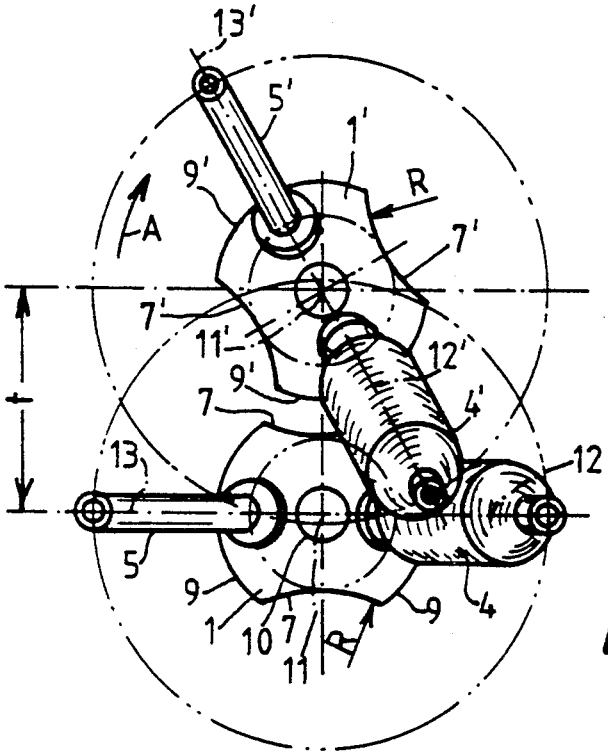
FIG. 2 is a perspective view of the revolver configuration of FIG. 1, as seen in a direction parallel to the rotary axes of the revolvers.

Referring now to the figures of the drawings in detail and first, particularly, to FIGS. 1 and 2 thereof, there is seen a first exemplary embodiment of an apparatus for changing bobbin tubes in a ring spinning machine which is shown purely diagrammatically, with components that are essential to the functioning thereof. The ring spinning machine itself may be of a known construction.

In the apparatus of the first exemplary embodiment, one revolver 1 is assigned to each spinning station of a ring spinning and winding machine. The revolver 1 is rotatably supported about an axis 11 that is fixed relative to the machine. Each revolver has two spindles 2 and 3 with axes 12 and 13 which are inclined at identical acute angles $\alpha$ relative to the revolver axis 11 and diverge in the direction of the free ends of the spindles.

In the operating position, the axis 12 of the spindle 2 is in the vertical position, as is usual in conventional spinning machines, so that a ring rail which is not shown in FIG. 1 can be vertically raised and lowered onto the bobbin tube. The other spindle 3 of the pair is in the unreeling or unwinding position and is inclined by approximately 45° relative to the spindle axis 12 in the exemplary embodiment. The spindles shown in FIGS. 1 and 2 are respectively shown as being equipped with a finished spinning cop 4 and an empty tube 5 in order to illustrate the paths taken and the space required, especially during the rotation of a revolver and the rotation of the full and empty bobbin tubes retained thereon. All of the spindles and bobbin tubes are shown as being cylindrical, in order to simplify the drawing.

Concavely curved recesses 7 which are each formed at two opposite circumferential segments of the revolver 1, have radii of curvature R being adapted to the distance between the rotary axes 11, 11' of adjacent revolvers 1, 1'. The recesses are formed in the longitudinal segments of the periphery located between the spindle outlets. Circumferential regions 9, 9' adjacent the spindle outlets and remote from the axes are preferably convexly curved by the same radius R. Otherwise the shape of the revolver and in particular the construction of the top of the revolver at the outlets of the spindles and of the bottom, with a bearing opening 10 coaxial with the revolver axis 11, is uncritical and can be adapted to the given configurations of the machine frame.

FIG. 2 is a perspective view from above showing the path of motion and the relative location of adjacent spindles and cops upon the rotation of a revolver. The revolver 1' adjacent the revolver 1 is shown in a position rotated by approximately 60° in the direction of arrow A from the operating position. This is the position in which the finished cops 4 and 4' come closest to one another. Both the axis 12' and the axis 13' form the generatrix of a truncated cone upon rotation of the revolver 1', with the apex 14 of the cone being located below the revolver along the rotary axis 11 of the revolver. A somewhat wider truncated cone is formed by the outer jacket surface of the finished cop 4'. In the 180° rotation, the cop 4' overtakes the V-shaped region located above the adjacent revolver 1, between the cop 4 and the empty tube 5, without colliding with the jacket surfaces thereof. The cross section of the cone can be reduced if necessary by reducing the apex angle $\alpha$. The inclination of the spindle axes makes it possible to retain the current minimum ring spinning spacing t of 75 mm, for example, while the spinning and winding spindles can be changed with optimally speed. As FIGS. 1 and 2 show, the V-shaped space between the spindles 2 and 3 associated with one revolver 1 offers sufficient free space precisely in the top region for unhindered performance of the spinning and winding operations.

Time-tested spindle bearings can be used. In order to drive the spindles during spinning action, tangential belts or individual drive mechanisms may be used. The rotation of the revolver 1, 1' is preferably effected by a non-illustrated central shaft, with all of the even-numbered and odd-numbered revolvers being rotated in alternation about the associated rotary axes thereof by 180°, in the same direction of rotation. Upon each rotation of a revolver, the adjacent revolvers on both sides remain in their spinning and winding positions, so that the (minimum) spindle spacing can be retained.

Figure 4A:
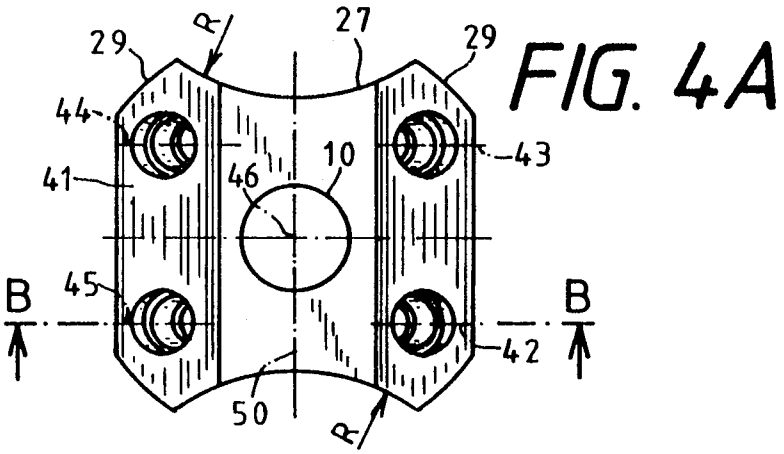
FIGS. 4A and 4B are views corresponding to FIGS. 3A and 3B of a modified embodiment of a revolver having spindle axes being inclined toward the rotary axis of the revolvers.

The revolvers shown in FIGS. 3 and 4 each serve two spinning and winding stations. These figures only show the revolvers with their central bearing openings or bores 10 and receiving bores 30 which are concentric with the spindle axes, for the spindles and spindle bearings.

Figure 3A:
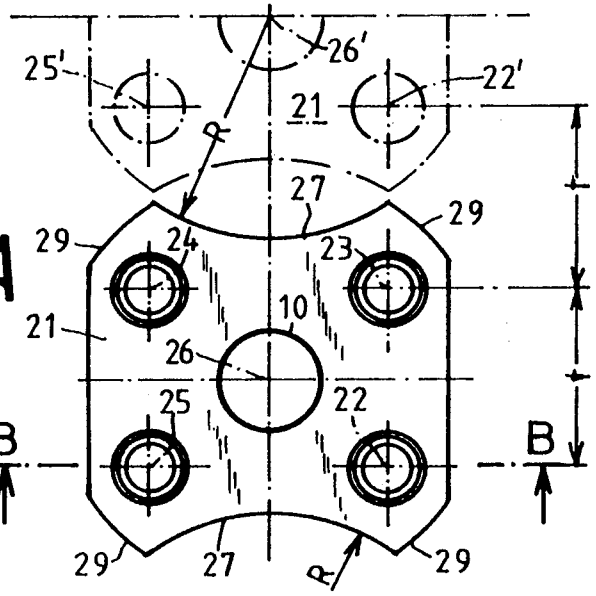
FIGS. 3A is a plan view and FIG. 3B is a sectional view taken along the line B—B in FIG. 3A in the direction of the arrows, showing a revolver for retaining four spindles, according to an exemplary embodiment of the invention.
Figure 3B:
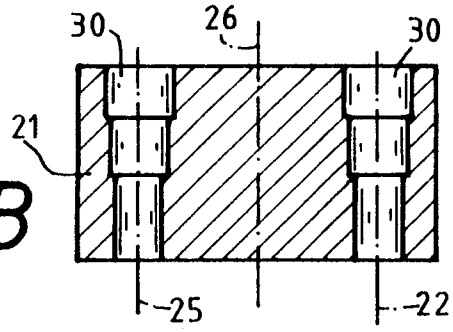

FIGS. 3A and 3B show the simplest version of a revolver 21, in which four spindle axes 22, 23, 24, 25 are disposed parallel to one another and concentrically about a rotary axis 26 of the revolver. Recesses 27 which are curved in an arc are formed similarly to the exemplary embodiment of FIGS. 1 and 2 on two opposed circumferential segments, with radii of curvature R which are adapted to the distance between adjacent revolver axes 26' of adjacent revolvers 21'. Circumferential regions 29 of each revolver 21 and 21' that are remote from the axes are adapted to the radii of curvature R of the recesses 27, so that the paths of motion of the outermost circumferential regions 29 can approach the concave recess 27 as close as possible yet without touching it.

The receiving bores 30 have three cylinder segments seen in FIG. 3B that are widened in stepped form toward the spindle outlet.

In FIG. 3A, the revolvers 21, 21' and the spindle retaining bores 30 thereof are shown in the operating position, in which the spindles are in the spinning or unreeling positions. The axes 22 and 23 of spindles that are adjacent one another in the longitudinal direction of the machine (along the arrow B) are spaced apart by a distance equivalent to the spindle spacing t. The adjacent axes 23 and 22' of the two adjacent revolvers 21 and 21' have the same spacing t. With the revolver 21, the change of bobbin tubes is performed simultaneously at two spinning stations and two winding stations, thus lessening the operating effort and expense, and reducing the number of moved parts that must be separately controlled. Unlike the exemplary embodiment described above, the spindles belonging together or in other words alternatingly serving the same spinning and unreeling or unwinding stations are in association with the respective spindle axes 22 and 24, as well as 23 and 25, but these are not the spindles located transversely alongside one another in the direction corresponding to the section line B—B, having the spindle axes 22 and 25, but instead they are the pairs of spindles that are disposed crosswise, in other words diametrically to the revolver axis 26. They each change their position upon a spindle rotation through 180°. However, the association of the winding stations with the spinning stations is of no significance for the functional characteristics of a ring spinning and winding machine.

The embodiment of the revolver 41 shown in FIG. 4 differs from the embodiment 21 of FIG. 3 due to the fact that the spindle axes 42–45 are inclined symmetrically by an angle $\beta$ relative to a plane 50. The revolver axis 46 is located in the plane of symmetry 50. Two spindle axes 42 and 45 or 44 and 43 at a time are located in a vertical plane (for instance the sectional plane B—B) but belong to different spindle pairs, or in other words serve adjacently located spinning stations and winding stations.

Figure 4B:
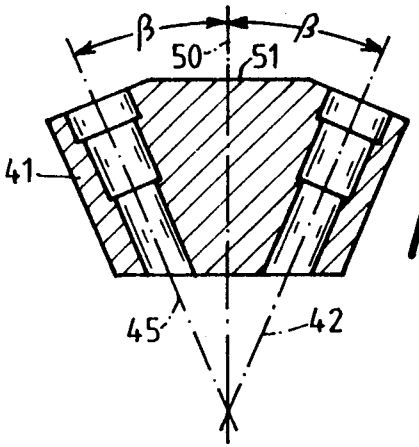

As a comparison of FIGS. 3B and 4B particularly shows, the inclined configuration of the spindle axes 42 and 45 makes substantially more free space available for performing the spinning and unreeling or unwinding operations because of the spreading toward the free ends of the spindles, while the revolver volume and diameter otherwise remain the same. The revolvers can therefore be made even more compact with the inclined spindle configuration of the embodiment of FIG. 4, and the spindle spacings t, which in this case are shown as being the same, can be made smaller.

In the version of FIG. 4, the shape of the top of the revolver 41 is also uncritical. In FIG. 4B, a gable-shaped top profile 51 is shown, which holds down the amount of raw materials and the expenditure for manufacture, while providing advantageous operating properties. As can be seen, the spindle axes 42, 45 pass through the flat segments of the top profile 51 associated therewith at a right angle, which is advantageous for performing both the spinning operation and the unreeling or unwinding operation.

Revolvers having the structure shown in FIGS. 3 and 4 can also be equipped with more than two spindle pairs in association with more than two spinning, twisting or winding stations. This reduces the number of changing operations per unit of time and thus lowers the operating and structural expense, but increases the (usually uncritical) amount of space required in the transverse direction of the machine, or in other words at right angles to the spindle spacing t.

Figure 5:
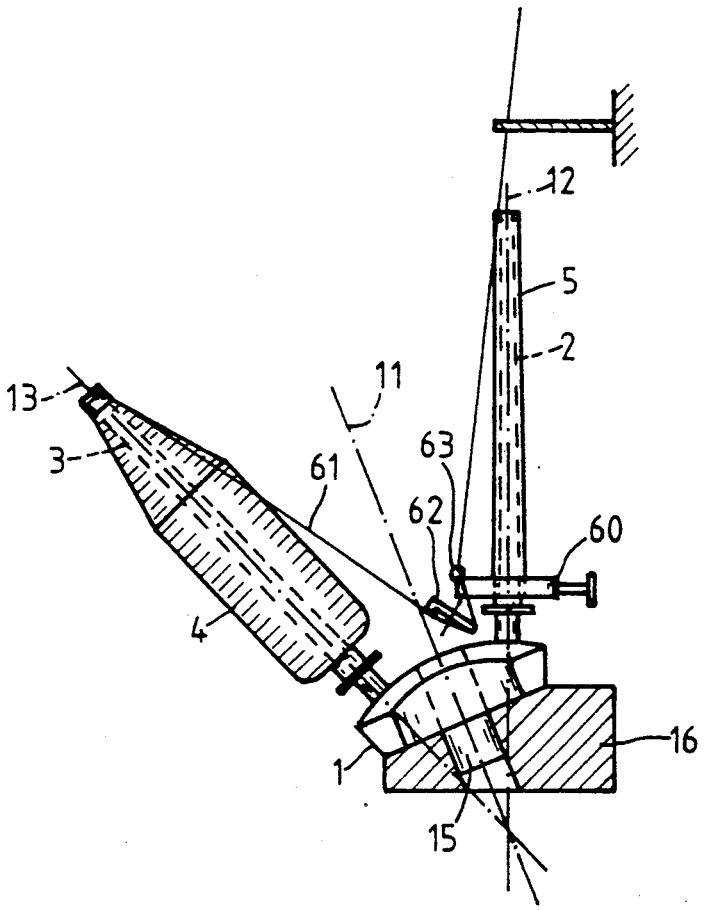
FIG. 5 is a partly sectional view of an exemplary embodiment having a yarn catching and cutting device, which becomes operative upon or immediately after the change of bobbin tubes and before the resplicing.

In FIG. 5, a bobbin tube changing apparatus is shown diagrammatically along with the components near the spindle of a spinning station. The revolver is constructed like the revolver 1 of FIG. 1. The revolver is rotatably supported by a bearing 15 on a spindle rail 60, which is only diagrammatically shown. In FIG. 5, the revolver is shown immediately after the change of bobbin tubes and before resplicing on the bobbin tube 5 located in the spinning position. A ring rail 60, which again is only diagrammatically illustrated, can be raised overhead above the free end of the spindles or bobbin tube 5, and after a rotation of the revolver 1 into the position shown in FIG. 5, it can be lowered back into the lowermost position for the splicing operation. Splicing is performed through a suitable catching and clamping device. Once the ring rail 60 has been lowered into the lowermost position, a yarn 61 runs from the top winding on the spun bobbin tube 4 then located in the winding position, through a diagrammatically shown pressing and cutting device 62, and from there through a spinning ring 63 and past the top region of the tube 5, upward into the pigtail or spinning triangle. The pressing and cutting device 62 is preferably pivotably secured to the ring rail 60. In the cutting position shown in FIG. 5, the pressing and cutting device 62 is in the V-shaped space between the two bobbin tubes 4 and 5, which are retained on the revolver 1. The yarn leading to the cop 4 to be unreeled or unwound is cut from the yarn end to be spliced, no later than upon arrival of the spindle carrying the empty tube 5. This reliably avoids the formation of double yarns or flats.

We claim:

1. Apparatus for changing yarn carriers in a textile machine, comprising a revolver having an axis, a pair of spindles being disposed on said revolver symmetrically to the revolver axis, said spindles having axes, ends disposed on said revolver and free ends, said spindles of said pair being rotatable in mutual alternation between a spinning position and an unwinding or disposal position, the axes of said spindles of said pair being inclined relative to the revolver axis by an acute angle and diverging in a direction toward the free ends of the spindles, and including at least one other revolver having an adjacent axis, said spindles having outlets, said revolver having circumferential segments located between the spindle outlets, and said revolver having recesses formed in said circumferential segments, said recesses being curved in the form of arcs with radii of curvature being adapted to a distance from an adjacent revolver axis.

2. Apparatus according to claim 1, wherein the spindle axes of the two spindles of the pair are angularly offset by 180° and form the generatrix of a cone, the cone being open toward the free ends of the spindles and having a center axis coextensive with the revolver axis.

3. Apparatus according to claim 1, wherein the spindle axes extend vertically in a spinning or twisting position, and the revolver axis is inclined at an acute angle relative to a vertical plane.

4. Apparatus according to claim 1, wherein said revolvers have circumferential regions remote from the axes thereof, and adjacent revolvers have circumferential dimensions and distances between each other causing said circumferential regions to plunge into a recess of an adjacent revolver held stationary in a spinning station upon rotation about its own revolver axis.

5. Apparatus according to claim 1, including yarn cutters associated with each spindle pair being operative in a region between said spindles located in the spinning position and in a winding position.

6. Apparatus according to claim 1, wherein the textile machine is one of the group of ring spinning machine, funnel spinning machine and ring twisting machine.

7. Apparatus for changing yarn carriers in a textile machine having spinning stations, comprising a revolver having an axis, at least two pairs of spindles disposed on said revolver symmetrically to the revolver axis for serving at least two adjacent spinning stations, said spindles of each respective pair being rotatable in alternation with each other between a spinning position and an unwinding or disposal position, said spindles having axes, and each two adjacent spindle axes being mutually parallel at a given spacing and being inclined relative to said revolver axis, and including at least one other revolver having an adjacent axis, said spindles having outlets, said revolver having circumferential segments located between the spindle outlets, and said revolver having recesses formed in said circumferential segments, said recesses being curved in the form of arcs with radii of curvature being adapted to a distance from an adjacent revolver axis.

8. Apparatus according to claim 7, wherein the spindle axes extend vertically in a spinning or twisting position, and the revolver axis is inclined at an acute angle relative to a vertical plane.

9. Apparatus according to claim 7, wherein said revolvers have circumferential regions remote from the axes thereof, and adjacent revolvers have circumferential dimensions and distances between each other causing said circumferential regions to plunge into a recess of an adjacent revolver held stationary in a spinning station upon rotation about its own revolver axis.

10. Apparatus according to claim 7, including yarn cutters associated with each spindle pair being operative in a region between said spindles located in the spinning position and in a winding position.

11. Apparatus according to claim 7, wherein the textile machine is one of ring spinning machine and funnel spinning machine.

12. Apparatus for changing yarn carriers in a textile machine having twisting stations, comprising a revolver having an axis, two pairs of spindles disposed on said revolver symmetrically to the revolver axis for serving at least two adjacent twisting stations, said spindles of each respective pair being rotatable in alternation with each other between a spinning position and an unwinding or disposal position, said spindles having axes, and each two adjacent spindle axes being mutually parallel at a given spacing, said mutually parallel pairs of spindle axes being inclined relative to said revolver axis.

13. Apparatus according to claim 12, wherein the spindle axes extend vertically in a twisting position, and the revolver axis is inclined at an acute angle relative to a vertical plane.

14. Apparatus according to claim 12, including at least one other revolver having an adjacent axis, said spindles having outlets, said revolver having circumferential segments located between the spindle outlets, and said revolver having recesses formed in said circumferential segments, said recesses being curved in the form of arcs with radii of curvature adapted to a distance from an adjacent revolver axis.

15. Apparatus according to claim 14, wherein said revolvers have circumferential regions remote from the axes thereof, and adjacent revolvers have circumferential dimensions and distances between each other causing said circumferential regions to plunge into a recess of an adjacent revolver held stationary in a spinning station upon rotation about its own revolver axis.

16. Apparatus according to claim 12, including yarn cutters associated with each spindle pair being operative in a region between said spindles located in the spinning position and in a winding position.

* * * * *